United States Patent [19]

Fritz

[11] Patent Number: 4,815,579

[45] Date of Patent: Mar. 28, 1989

[54] TESTING DEVICE FOR COINS OF DIFFERENT DIMENSIONS AND DIFFERENT ELECTRO-MAGNETIC PROPERTIES

[75] Inventor: Siegenthaler Fritz, Trub, Switzerland

[73] Assignee: Autelca AG., Gümligen, Switzerland

[21] Appl. No.: 49,505

[22] Filed: May 14, 1987

[30] Foreign Application Priority Data

May 14, 1986 [CH] Switzerland ..... 01965/86

[51] Int. Cl.[4] ..... G07D 5/02

[52] U.S. Cl. ..... 194/318; 194/334; 194/335; 453/3

[58] Field of Search ..... 194/317, 318, 319, 328, 194/330, 334, 335, 344, 346; 453/3; 73/163

[56] References Cited

U.S. PATENT DOCUMENTS

| | | | |
|---|---|---|---|
| 1,236,870 | 8/1917 | Reith | 194/330 |
| 1,354,647 | 10/1920 | Hill | 194/330 |
| 3,191,739 | 6/1965 | White, Jr. | 194/335 X |
| 3,738,469 | 6/1973 | Prumm | 194/318 |
| 3,896,916 | 7/1975 | Ruzic et al. | 194/335 |
| 4,108,296 | 8/1978 | Hayashi et al. . | |
| 4,124,110 | 11/1978 | Hovorka | 194/318 |

FOREIGN PATENT DOCUMENTS

| | | | |
|---|---|---|---|
| 0122732 | 10/1984 | European Pat. Off. . | |
| 1806439 | 5/1970 | Fed. Rep. of Germany | 194/317 |
| 8303154 | 9/1983 | World Int. Prop. O. | 73/163 |

*Primary Examiner*—Kevin P. Shaver
*Assistant Examiner*—Edward S. Ammeen
*Attorney, Agent, or Firm*—Brady, O'Boyle & Gates

[57] ABSTRACT

Two sensors (2, 3) are placed opposite each other against the rim of the coin (5). By this, a signal, corresponding to the diameter of the coin (5) is produced and a drive (18/19, 23/24) is driven which moves two support members in order to support a coin between them (13), the diameter of which corresponds to the distance between the sensors (2, 3) in a position that is centered to a test coil (10) of an inductive coin testing device.

9 Claims, 3 Drawing Sheets

TESTING DEVICE FOR COINS OF DIFFERENT DIMENSIONS AND DIFFERENT ELECTRO-MAGNETIC PROPERTIES

BACKGROUND OF THE INVENTION

The invention concerns a coin checking device.

In known coin checking devices the diameter of the coin is checked either mechanically or inductively. The mechanical checking is done according to the principle applied to the usual caliper gauge, for example by dimensioning the coin slit such that coins whose diameter exceeds an upper limit cannot pass and the slanted coin channel has a side window through which coins fall which are smaller than a lower limit value. (EP-A2-0 122 732). This requires for each acceptable coin type a separate, fitting coin slit and a separate coin channel with an individually fitted window. The refitting of the coin slit and the channal from one diameter range to another is expansive and an actual diameter measuring is not possible in this manner. For inductive checking the coin influences the field with a high-frequency excited coil in one measurement, dependent on the coin diameter, from which an analog signal is obtained that indicates if the coin has the diameter of the coin to be accepted (U.S. No. Pat. 4,108,296). The refitting from one diameter range to another is also expensive, even if the signal is changed from analog to digital and evaluated by a microprocessor; because of the stray field of the coil there is no linear connection between the coin diameter and the signal size so that the coin checker cannot be simply programmed for another coin diameter. It is much rather necessary to first empirically determine the signal size assigned to the other coin diameter and reprogram according to this dimension.

The invention provides relief for this. The invention solves the problem by creating a coin checking device which supplies a mathematically defined control value dependent on the distance of the sensor when contacting the coin edge.

SUMMARY OF THE INVENTION

In the coin checking device the thrust propulsion preferably is a linear drive, driven by a step motor (linear connection between drive rotation and driven thrust), a counter counts the pulses driving the step motor, starting from a predetermined distance of the sensors to their contacting the coin edge, and in a microprocessor a signal, proportional to the coin diameter, is formed by subtraction of the pulse number from a constant.

The value dependent on the distance of the sensors can particularly also be the position of one or two support members which, by means of a drive driven together with the thrust propulsion, suitably a cam gear, are moved in such a manner that, with the respective distance of the sensor, they support a coin with the diameter corresponding to this distance in a position for the support of this coin in a coaxial position to the coil field of an inductive testing device.

The sensors and the thrust propulsion can be arranged in a test station, the test coil or two coaxial test coils for the inductive coin checking can be arranged together with one or two support members in the same or in a second test station, arranged below the first test station. The joint or only the second test station can be shiftable in order to distribute the checked coins into different storage areas or the channels leading to them, wherby the shifting of the second test station makes it possible, with a corresponding design, to measure the diameter of the next coin while the second test station is still on its shifting path.

The advantages attained by this invention can be primarily seen in the fact that a particularly proportional signal can be obtained, exactly corresponding to the coin diameter, so that—if the device is equipped with a microprocessor—it is possible to directly program for the single or multiple coin diameter(s) and thus provide for a simple and rapid refitting for other coins, and that the coins, with inductive checking, independent of the coin diameter, are in a position concentric to the coil field, so that the checking is considerably more precise and reliable. As each coin is supported during the inductive checking, it is possible, for the further improvement of the precision and reliability of this checking, to press a test coil to one side or two coaxial test coils opposite each other to both sides of the coin. This makes it possible to simultaneously determine from the position of the pressure exerting organ a measuring value for the exact determination of the coin thickness. This makes it possible to much more critically distinguish acceptable coins from unacceptable ones. The combination of all tests in a single or all tests except the diameter check in the second test station, is space saving, particularly if the second test station is arranged directly below the first one. This, as well as the type of distribution of the tested coins avoids coin channels and coin switches that are subject to failure. Other details and advantages can be seen from the following description.

BRIEF DESCRIPTION OF THE DRAWINGS

Below the invention is described in more detail by reference to a simplified drawing, showing only one type of design, in which.

The drawings show the coin checking device only in its essential part for the current context. In their basic design, these devices consist of the following components, described in more detail below:

DESCRIPTION OF THE PREFERRED EMBODIMENT

Figure 2:
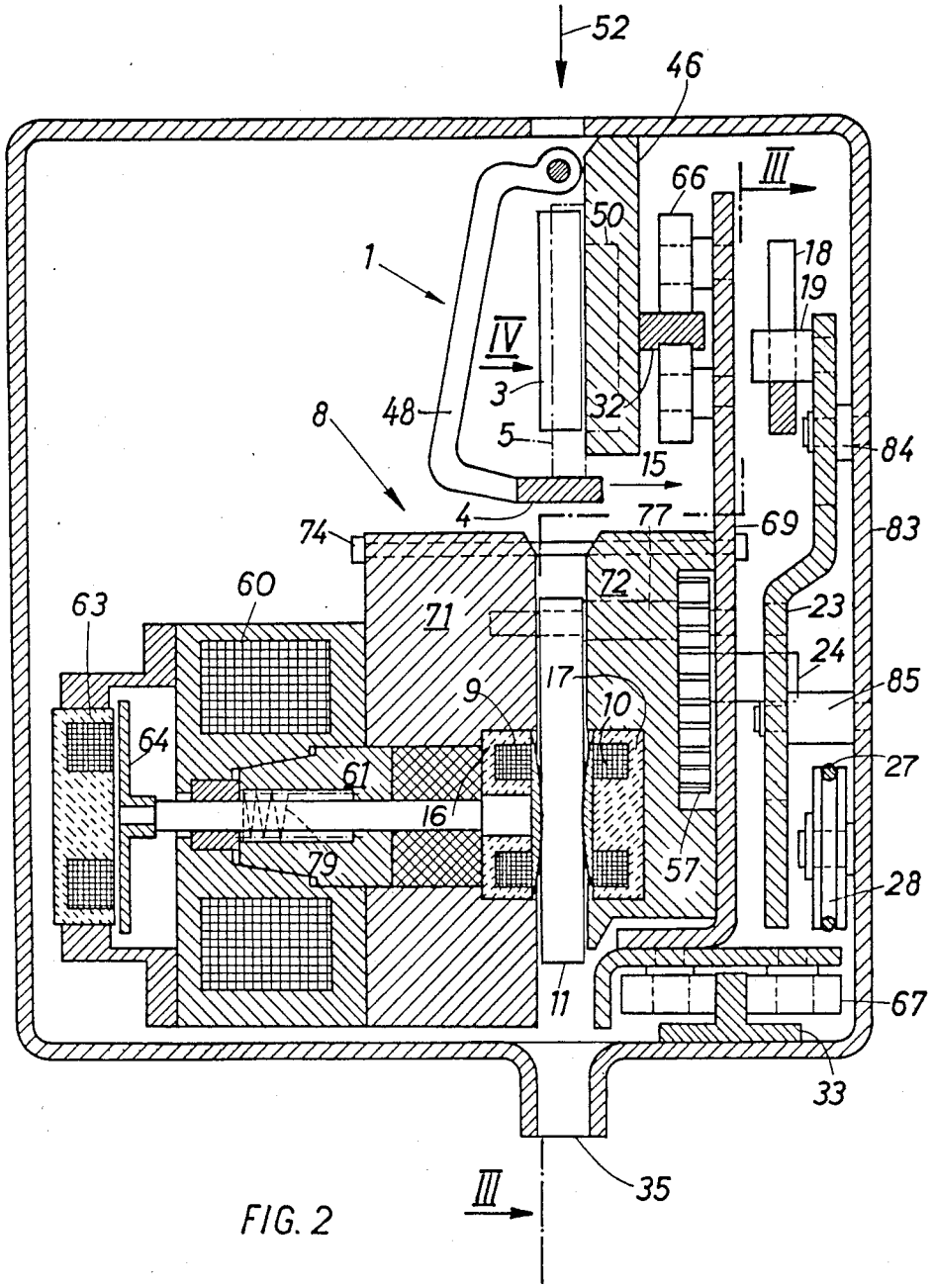
FIG. 2 is a cross section view taken substantially on line II—II in FIGS. 1 and 3.
Figure 4:
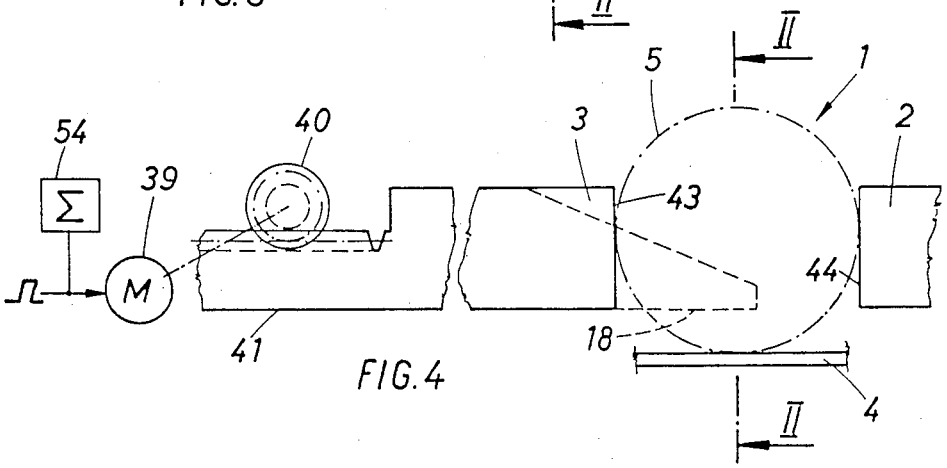
FIG. 4 is a partial view taken in the direction of arrow IV in FIG. 2.

A first test station 1 (FIGS. 2 and 4) with a fixed and a movable sensor 2 and 3 for measuring the diameter of the coin 5, supported by a support 4.

A second testing station 8 (FIGS. 2 and 3) with two coaxial test coils 9 and 10 for inductive testing of the coin alloy and two support members 11 and 12 for supporting the coin 13 in a position centered relative to the coils 9 and 10.

The test coil 10 is arranged in a fixed manner and the test coil 9 movably in order to inductively test the coin 13 resting against both test coils 9 and 10, whereby the thickness of the coin 13 is simultaneously determined and the coin can be held between these two coils when the support members 11 and 12 leave their position supporting the coin 13. The second test station 8 is located in its shown resting position, below the first test station 1, so that the coin 5 falls directly between the test coils 9 and 10 and the support members 11 and 12 into the position designated by 13 when the support 4 is pivoted to the side (arrow 15, FIG. 2).

A thrust cam drive (FIGS. 2 and 3) with a first drive step 18, 19, driven together with the movable sensor 3, which moves the support members 11 and 12 in such a manner that with the respective distance of sensors 2 and 3, they support a coin in position 13, the diameter of which corresponds to this distance, in a position that is coaxial to the test coils 9 and 10 when the second test station 8 in its (shown) resting position, is located below the first testing station 1; and with a second drive step 23, 24, which moves the support members 11 and 12 into a position not suitable to the support of a coin, independent of the condition of the first drive step 18, 19 when the second test station 8 leaves its resting position in the arrow direction 25 and returns the support members 11 and 12 into the position dependent on the distance between the sensors 2 and 3 as the second test station 8 again approaches its resting position.

Figure 1:
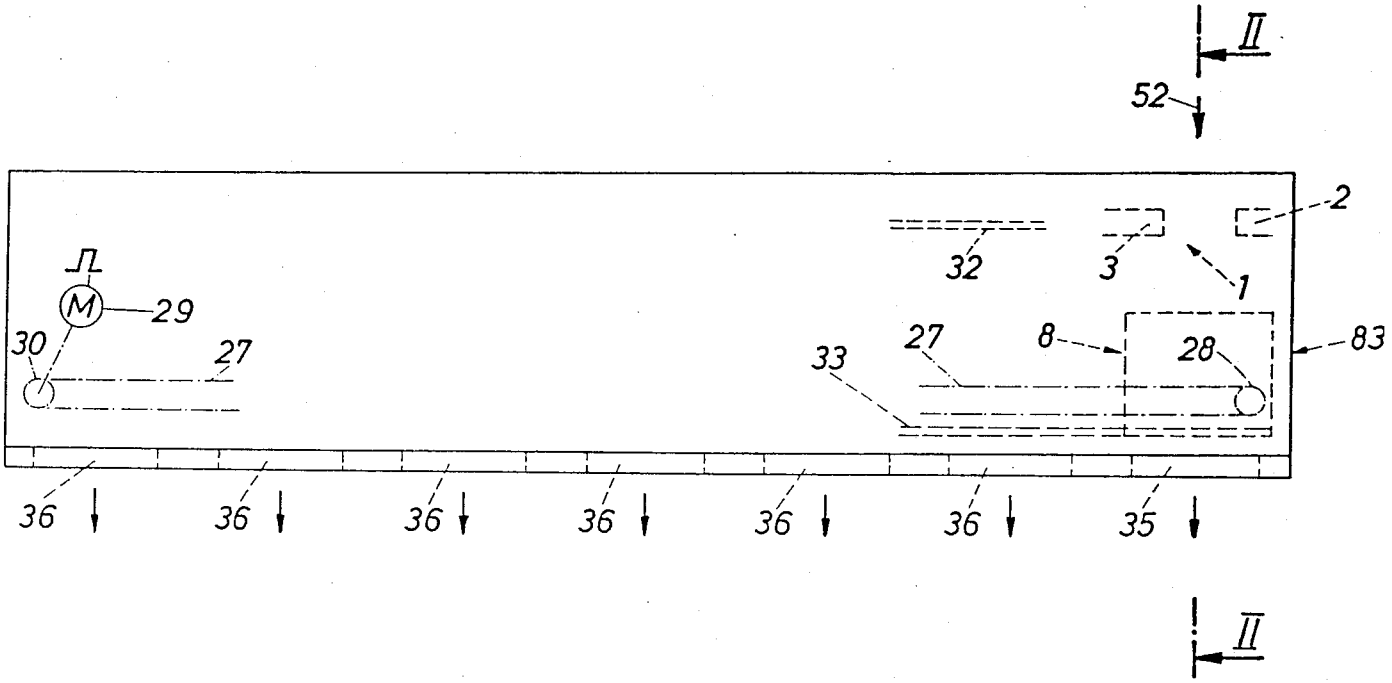
FIG. 1 is a simplified lateral view of a coin checking device.

A shifting drive 27–30 (FIG. 1) by means of which the second test station 8 can be shifted along a shifting track 32, 33 each time to one of several coin exits 35, 36 of the coin checking device. Exit 35 leads to a not shown return channel for not accepted coins. Each of the exits 36 leads to a not shown container for one of the accepted types of coins.

Included in the first coin testing station 1 (FIGS. 2 and 4) are, besides the sensors 2 and 3 and the support 4, a thrust drive with a reversable step motor 39 which drives a pinion 40 of a rack-and-pinion gear 40, 41. At one end of its toothed rack 41 the movable sensor 3 is formed. The sensors 2 and 3 have parallel scanning surfaces 43, 44 and are arranged on one side of a plate 46 which forms a guide surface for one side of the coin 5. A guide surface for the other side of the coin is not shown. The distance between these guide surfaces is somewhat greater than the thickness of the thickest coin. The play of the coin between these guide surface has no influence on the measurement of the coin diameter. Support 4 can be moved laterally by means of a pivoting mechanism, of which only the pivoting arm 48 is shown, in the direction of arrow 15.

Inserted into plate 46 is a sensor coil 50 for the control of the coin checking device. When a coin drops from a not shown coin feeding device in arrow direction 52 into the first test station 1, a signal is triggered by means of the sensor coil 50 which causes a blocked condition of a block designed into the coin feeding device and maintains it until this coin 5 has left the first test station 1 by moving the support 4 from its shown position, supporting the coin 5, in the arrow direction 15 to release the coin 5 to the second test station 8. The signal by the sensor coil 50 triggered by the arrival of the coin 5, starts the step motor 39 in the forward thrust direction of the sensor 3. Between this motor 39 and the pinion 40 a not shown shaft coupling with a contact is provided which is put into operation by the increase of the rotation when the two sensors 2 and 3 contact the edge of the coin 5 in order to stop the step motor 39. The counted pulse number corresponds to the sensor forward movement. The microprocessor connected to counter 54 of the device determines the diameter of thecoin 5 by subtracting the forward thrust distance (or the corresponding pulse number) from a constant given by the starting distance between the sensors 2 and 3, and tests in the usual manner if the coin 5 is an acceptable coin on the basis of its diameter.

The second test station 8 (FIGS. 2 and 3) comprises, apart from the two support members 11 and 12 and the test coils 9 and 10 for the inductive coin testing, a toothed gear 57, 58 for the symmetrical pivoting of the support members 11 and 12, a magnetic coil 60 with solenoid plunger 61 for the shifting of coil 9 and an inductive measurement transducer 63, 64 which supplies a signal, dependent on the position of the coil 9, for measuring the thickness of the coin 13. The second test station 8 is designed as a sled which is led by means of rollers 66, 67 along the rails 32 and 33, forming the shift track and is movable by means of the shift drive 27–30, described in detail below. In the shown resting position, serving the inductive coin testing, the second test station 8 sits below the first test station 1 in such a manner that a coin released by operating the support 4, falls directly between the coils 9 and 10 and support members 11 and 12.

The parts of the second test station 8 are arranged on a support plate 69 on which the rollers 66 and 67 are mounted. On the support plate 69 two bodies of insulating material, 71 and 72, are held at a distance from each other by bolts 74. In the body 71 the test coil 9 is mounted in an axially shiftable coil shell 16, and in the body 72, the test coil 10 is mounted in a fixed coil shell 17. The pivotable support members 11 and 12 are arranged between the bodies 71 and 72, each is set on a shaft 76 and 77, mounted in borings of the bodies 71 and 72. On each shaft 76 and 77 sits one of the interlocking toothed wheel segments 57 and 58 which form the toothed wheel drive. The coil shell 16 with test coil 9 is urged by a spring 79 (only partially shown) in the direction towards the coil shell 17 with test coil 10 and, with the solenoid-plunger—to which the magnetic coil 60 is assigned—firmly connected to a plate 64 of magnetically conductive material, which, together with the induction coil 63, forms the inductive measurement transducer, by means of which a signal, proportional to the thickness of the coin 13, is produced when the coil is not excited, so that the spring 79 presses the test coil 9 against the coin 5 in the position 13 between support members 11 and 12, and thus presses the coin 5 against the test coil 10. The facing front surfaces of the coil shells 16 and 17 carry thin coatings with slightly spherically bent outer surfaces. This has the effect that a possible bending of the coin does not influence either the inductive testing of the testing of the coin thickness. The measurement transducer is designed in such a manner that its measuring value is a linear function of the coin thickness, so that it can be simply obtained by subtracting the measured value from a constant in a logic circuit.

The thrust cam drive (FIGS. 2 and 3) has in its first drive step a curve support 18 fixed to the rack 41 (see also FIG. 4), to the curve 81 or inclined edge of curve support 18, a lug 19 is in contact. The lug 19 is firmly connected to the curve support 23 of the second drive step which is vertically shiftable on bolts 84, 85 affixed to the rear wall 83 of the housing, mounted in slits 87, 88 (FIG. 3) of the curve support 23. On the curve or inclined edge 90 of the second curve support 23' a lug 24 is led whichis eccentrically mounted on the toothed wheel segment 57 so that it forms a crank pin for the pivoting of the support members 11 and 12. Not shown stops limit the turning radius of the toothed wheel segments 57 and 58, and a not shown retention spring is set to hold the support members 11 and 12 at a distance from each other at which they do not support the coin in position 13 any longer. This retention spring also assures a frictional connection of the second drive step 23', 24. In the shown resting position of the second test station 8, the lug 24 rests against a non-rising edge part 91 of the curve or incline 90 on the curve support 23. In this, the lug 24 follows the vertical drive motion of the first drive step 18, 19. In the example shown, its curve or incline 81 is straight and the support surfaces 93 and 94 facing each other of the support members 11 and 12 are bent concavely in such a manner that, with the respective distance of the sensors 2 and 3, hold a coin at position 13, the diameter of which corresponds to this distance, in a centered position relative to the test coils 9 and 10. This can basically also be attained with straight support members and a bent curve or incline 81 or by the fact that the incline 81 as well as the support surfaces 93, 94 are bent. It should be observed that the connection between the vertical motion of the crank pin 24 and the rotation of the toothed wheel segment 57 and 58 is not linear.

Figure 3:
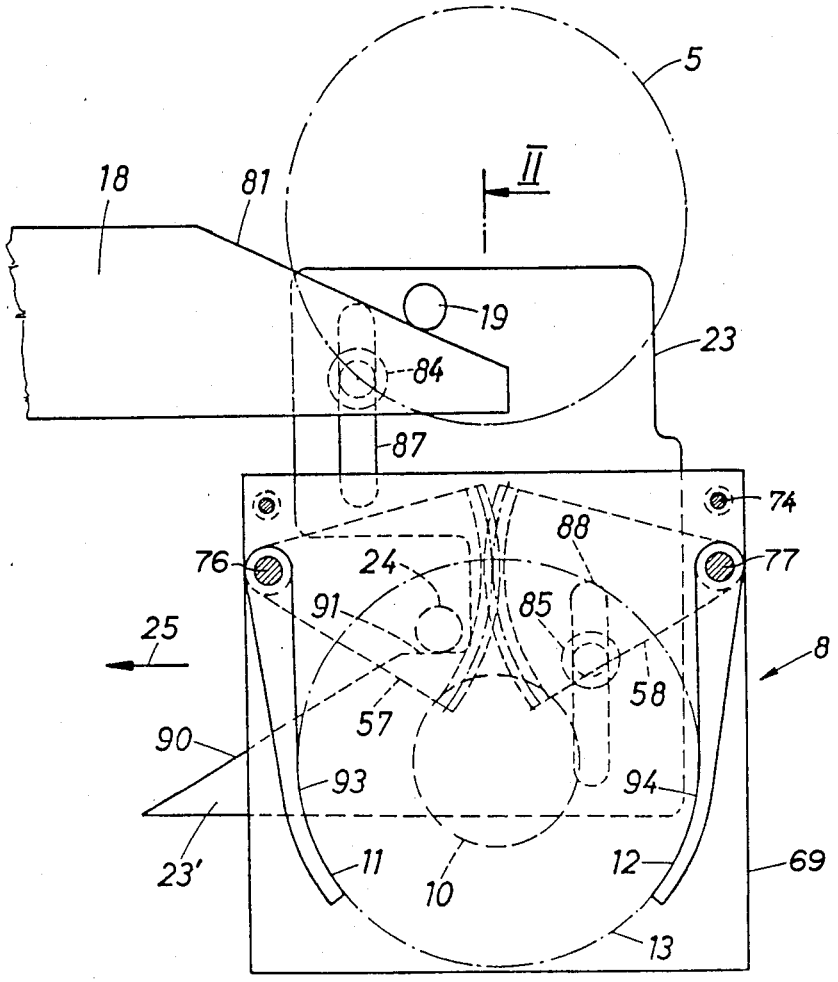
FIG. 3 is a longitudinal section view taken substantially on line III—III in FIG. 2

When the second test station 8 leaves its position shown in FIG. 3 in the direction of arrow 25, the lug 24 slides downward along curve or incline 90 and the support members 11 and 12 pivot away from each other, but they will again reach their position determined by the distance of the sensors 2 and 3 when the second test station 8 returns to the shown position, whereby lug 24 is again led to the curve section 91.

The shifting drive (FIG. 1) for shifting the second test station 8 along the shifting track formed by rails 32 and 33, is a rope drive with a practically non-expanding rope 27, a reversal roller 28 and a rope drum 30, driven by a step motor 29. The second test station 8 is attached to one point of one of the belts or the rope 27. The ends of the rope 27 are attached to the rope drum 30 and the end pieces of these ends of the rope 27 are wound onto the rope drum 30 in opposite direction, so that with a turning of the rope drum 30, the rope 27 is wound on one end and unwound on the other end. In this manner a slipping of the rope 27 is prevented and it is attained that the second test station 8 is each time shifted by a distance which exactly corresponds to the number of pulses driving the step motor 29 and thus the rope drum 30.

For checking a coin, the components of the device, described above with comments on their individual functions, work together as follows: in the resting position of the device, the sensors 2 and 3 have the predetermined starting distance which is greater than the diameter of the largest acceptable coin. The support 4 and the second test station 8 are in their position shown in the drawings. A coin arriving in arrow direction 52 from the coin feeding device, falls between the sensors 2 and 3 onto the support 4 (coin 5 in FIGS. 2 and 4). The signal triggered by the sensor coil 50 (FIG. 2) starts the step motor 39 (FIG. 4) which causes the forward push of sensor 3 until it hits the coin 5 and coin 5 hits sensor 2. During the foward motion of sensor 3, lug 19 runs along incline 81 of the first curve support 18 (FIG. 3) and lifts the second curve support 23', firmly connected to lug 19, and thus the crank pin 24 resting on its curve section 91, which has the effect that the support members 11 and 12 at the end of the forward motion of sensor 3 are in the position which is suitable to centrally support the coin 5 relative to the test coils 9 and 10. During the forward motion of the sensor 3, the counter 54 counts the pulses driving the step motor 39. The microprocessor determines the coin diameter from the counted pulse number. After the forward motion of the sensor, the support 4 is temporarily pivoted to the side (arrow 15, FIG. 2) in order to release the coin to the second test station 8. For this purpose, the sensors 2 and 3 are also removed from the coin 5 by the motor 39 driving the sensor 3 in reverse with a certain small number of pulses.

This small reverse distance is taken into account in the shaping of the support surfaces of the support members 11 and 12 (or the shape of the curve or incline 81). The coin drops between the blocks 71 and 72 or test coils 9 and 10 and the support members 11 and 12 which center the coin relative to the coils 9 and 10 and support it in the position designated by 13. In this, the magnetic coil 60 is excited in order to retract coil 9 against the force of the spring 79 to the extent that it does not extend into the space between the blocks 71 and 72. After the coin has dropped into the second test station 8, which can be recognized, for example, by the signal of coils 9 and 10, the excitement of the magnetic coil 60 is switched off, which has the effect that, under the influence of spring 79, coil 9 is pressed against the coin in position 13 and the coin against test coil 10. While the test coils 9 and 10 rest opposite each other against the coin 5, it is inductively tested in an actually known manner. Simultaneously a signal for measuring the thickness of coin 5 is produced by the measurement transducers 63, 64.

After switching off the excitement of the magnetic coil 60, the step motor 39 is operated for retracting sensor 3 into its starting position. During this time lug 19 runs downward along curve or incline 81 (FIGS. 3 and 4) and shifts the curve support 23 and with it crank pin 24 downward so that the support members 11 and 12 separate and no longer support the coin in position 13. However, the coin is still held in the second test station 8 as it is clamped in position 13 between its test coils 9 and 10 by the effect of spring 79.

Based on the measured diameter and the measured thickness as well as the result of the inductive test, the microprocessor connected with the step motors 39 and 29, counter 54, coil 50, solenoid coil 60, test coils 9 and 10, and transducer coil 63, determines if the coin in position 13 is acceptable. If it is not acceptable, the magnetic coil 60 is excited for a short time which causes the retraction of coil 9 and the coin in position 13, no longer supported by the support members 11 and 12, falls through exit 35 (FIGS. 1 and 2) into the not shown coin return channel.

If the coin is one of the acceptable types of coins, the second test station 8 is shifted by means of the shifting drive 27 to 30 (FIG. 1) to that one of the exits 36 which leads to the coin box designated (not shown) for the respective type of coin and the coin 5 is released into this coin box by means of a short exciting of the magnetic coil 60. The second test station 8 is then shifted back to its resting position. Should, in the meantime, another coin have gotten into the first test station 1, its sensors 2 and 3 will already have the distance corresponding to the diameter of this coin. As the second test station 8 now approaches its resting position, the crank pin 24 runs on curve or incline 90 along its curve segment 91 into the position in which the support members 11 and 12 receive this coin in a centered position relative to the test coils 9 and 10 as soon as it falls into the second test station 8, in which it is tested and release into one of the exits 35 or 36, as described above.

As a conceivable variation of the described embodiment of the coin checking device, it is possible to have, in place of the rack-and-pinion gear 40, 41, another linear gear or a gear with a drive thrust that is not a linear function of the drive rotation. In the latter case too it is possible to exactly determine the diameter of the coin, as the function is mathematically defined by the geometry of the gearing, so that it can be taken into account in the microprocessor. The sensors 2, 3 could, e.g., also be shiftable in opposite direction from each other by means of two toothed racks, interlocking with the opposite sides of the pinion 40 or by means of a spindel with right and left threading, whereby a single support member, shiftable vertically to the sensors, would support the coin, which is laterally supported by the sensors, in a central position relative to one or two coaxial test coils. The required shifting of the support member in this is proportional to the shifting of each of the sensors. It is naturally also possible to replace the two toothed wheel segments 57 and 58 by similarly working means, e.g., two cranks connected to each other by a connecting rod, and could, instead of being pivotable in the opposite direction, be shiftable opposite each other. In their place could also be a support member, shiftable vertical to the sensors, with two downward converging support surfaces for supporting the coin at two opposing rim position which, just like the single support member described above, could, for example, be shiftable parallel to the testing coil axis in order to permit the coin to drop.

I claim:

1. A coin testing device for coins of different dimensions and different electro-magnetic properties movable along a coin path, comprising a pair of sensors (2,3) spaced apart a variable distance on opposite sides of the coin path for receiving therebetween a coin (5) to be tested moving along said path;

sensor drive means (39–41) connected to at least one sensor (3) of said pair of sensors (2,3) for varying the distance between said sensors in order to push them diametrically opposite each other against the rim of said coin (5) and for loosening said pair of sensors from said coin without substantially changing the distance between said sensors;

inductive test coil means (9,10);

two downwardly converging support members (11,12) movably connected on opposite sides of the coin path for receiving therebetween and supporting said coin (5) at two rim positions opposite to each other when loosened from between said pair of sensors;

support member drive means (57,58) connected to move said support members (11,12) in opposite directions;

and intermediate drive means (18,19,23,24) connected to be driven by said sensor drive means (39-41), and connected to drive said support member drive means (57,58) in such a manner, to move said support members (11,12) in one direction to support a coin, the diameter of which corresponds to the distance between said sensors, in a position that is coaxial to said inductive test coil means (9,10), and to move said support members (11,12) in the opposite direction to release the supported coin.

2. A device according to claim 1, including bracket means (46,48) connected to support said coin (5) received between said sensors (2,3), and movable out of said coin path to let said coin drop for being received between said support members (11,12).

3. A device according to claim 1, in which said sensors (2,3) are normally spaced apart a predetermined starting distance;

means supplying a sequence of pulses;

said sensor drive means (39–41) comprising a linear drive (40, 41), and a step motor (39) driven by the pulses from said means supplying a sequence of pulses connected to drive said linear drive;

and a counter (54) connected to count the pulses to the step motor (39) during varying the distance of said sensors (2,3) from said predetermined starting distance to the distance wherein said sensors are placed diametrically opposite each other against the rim of said coin (5), thereby providing a signal corresponding to the diameter of the coin.

4. A device according to claim 1, in which said support member drive means (57,58) include a pair of intermeshing gear segments each fixedly connected to one of said support members (11,12).

5. A device according to claim 1, and said intermediate drive means (18,19,23,24) including a cam plate (18) driven by said sensor drive means (39–41), said cam plate having a cam edge (81), and a cam follower (19) guided on said cam edge (81) for driving said support member drive means (57,58).

6. A device according to claim 1, and said test coil means (9,10) including two members (16,17) positioned for receiving therebetween the coin (5) supported by said support members (11,12), one of said members (16) of said two members (16,17) being movable toward the other member (17) thereof;

said test coil means (9,10) including at least one test coil (9) mounted on said one of said members (16);

said two members (16,17) having convex surfaces opposed to each other and coaxial to said at least one test coil (9);

a shifting device (60,61,79) connected to move said one of said members (16) towards the other member (17) to clamp therebetween the coin (5) supported by said support members (11,12);

and transducer means (63,64) connected to be responsive to the position of said movable one of said members (16), to produce a signal corresponding to the thickness of the coin (5) clamped between said two members (16,17).

7. A device according to claim 6, in which said shifting device (60,61,79) includes a solenoid coil (60), a plunger (61) connected to be moved by said solenoid coil (60) and connected to said movable one of said members (16), and a reset spring (79) connected to said plunger (61).

8. A device according to claim 1, including a first stationary test station (1) including said sensors (2,3), said sensor drive means (39–41), and said intermediate drive means (18,19,23,24);

a second test station (8) including a carriage (69) carrying said support members (11,12), said support member drive means (57,58), and said test coil means (9,10);

a stationary track (32,33) for said carriage (69);

a plurality of coin exits (35), each assigned to one of the different types of coins, distributed along and arranged below said track (32,33);

a shifting device (27–30) connected for shifting said second test station (8) by means of said carriage (69) on said track (32, 33), to a rest position for receiving a coin from said first test station (1), and to plural positions along said track, each for transferring the coin received from the first test station (1) to one of said coin exits (35).

9. A device according to Claim 8, and said intermediate drive means (18, 19, 23,24) including a first cam plate (18) connected to be driven by said sensor drive means (39–41);

a second cam plate (23) connected for movement substantially perpendicular to said track (32, 33);

a first cam follower (19) connected to said second cam plate (23) and in guiding contact on said first cam plate (18);

a second cam follower (24) connected to said support member drive means (57,58) and in guiding contact with said second cam plate (23);

said second cam plate (23) having a contour cam portion (90,91) for maintaining said second cam follower (24) in a fixed position (91) relative to said second cam plate (23) during movement thereof, whereby the support member drive means (57, 58) is driven in dependence on the movement of said first cam plate (18), and for driving said second cam follower (24) to drive the support member drive means (57, 58) for releasing a coin supported by said support members (11,12), when said second test station (8) moves from said rest position on said track (32,33).

* * * * *